US005357919A

United States Patent [19]

Ma

[11] Patent Number: 5,357,919

[45] Date of Patent: Oct. 25, 1994

[54] HYDROCARBON EMISSION CONTROL

[75] Inventor: Thomas T. Ma, Chelmsford, Great Britain

[73] Assignee: Ford Motor Company, Dearborn, Mich.

[21] Appl. No.: 90,130

[22] PCT Filed: Jan. 16, 1992

[86] PCT No.: PCT/GB92/00089

§ 371 Date: Jul. 14, 1993

§ 102(e) Date: Jul. 14, 1993

[87] PCT Pub. No.: WO92/13181

PCT Pub. Date: Aug. 6, 1992

[30] Foreign Application Priority Data

Jan. 19, 1991 [GB] United Kingdom ..... 9101214

[51] Int. Cl.[5] ..... F02F 3/14

[52] U.S. Cl. ..... 123/193.2; 123/568

[58] Field of Search ..... 123/193.2, 568, 41.86

[56] References Cited

U.S. PATENT DOCUMENTS

| | | | |
|---|---|---|---|
| 1,530,864 | 3/1925 | Vaughan | 123/568 |
| 4,060,059 | 4/1977 | Blaser | 123/193.2 |
| 4,191,150 | 3/1980 | Siewert | 123/193.2 |
| 4,466,409 | 8/1984 | Asaka | 123/433 |
| 4,475,510 | 10/1984 | Asaka | 123/432 |

FOREIGN PATENT DOCUMENTS 1400815 6/1965 France .

*Primary Examiner*—Noah P. Kamen

*Attorney, Agent, or Firm*—Jerome R. Drouillard; Roger L. May

[57] ABSTRACT

A four-stroke spark ignited internal combustion engine has a variable volume working chamber and an auxiliary chamber having a fixed volume which is smaller than the maximum volume of the working chamber, with the working chamber and the fixed chamber being communicated by a series of passages in the cylinder wall. The passages in the cylinder wall are situated such that when the piston is near the top of its exhaust stroke, the end gases stored in the auxiliary chamber are discharged into the crankcase.

3 Claims, 1 Drawing Sheet

HYDROCARBON EMISSION CONTROL

FIELD OF THE INVENTION

The invention relates to the reduction of the hydrocarbon content of the exhaust gas emissions of a spark ignited four-stroke internal combustion engine.

BACKGROUND OF THE INVENTION

When the cyclic variation of the hydrocarbon content of exhaust gases is studied in detail, it is noted that there are peaks of high hydrocarbon concentration immediately when an exhaust valve opens and just before the exhaust valve closes. In a well tuned engine, the hydrocarbon concentration between these two peaks is significantly lower and within the range expected from complete combustion. The two peaks are not therefore caused by an incorrect fueling map and other reasons must be the cause of the presence of unburnt fuel in the exhaust.

The present invention is concerned with the cause of the second peak which occurs at the end of the exhaust event rather than the first peak. It is generally believed that a major cause of this problem is the presence in the combustion chamber of small crevices into which fuel can be compressed but into which the combustion flame cannot penetrate. One such crevice is that surrounding the piston top land that is to say the small space between the piston and the cylinder above the top piston ring. During the compression stroke, fuel and air are compressed into this space. During combustion, the expanding flame front pushes mixture ahead of it into this crevice tending to increase the amount of fuel stored even further. However, the flame cannot enter this crevice because it is bound by two cold walls and the flame is quenched during its attempt to penetrate into this gap. Consequently, a quantity of fuel remains trapped in the crevice throughout the power stroke until the pressure in the combustion chamber during the exhaust stroke drops to allow the unburnt charge to escape from the crevice. The unburnt charge will then reside near the top of the piston and will be discharged towards the end of the exhaust stroke.

Attempts have been made in the prior art to reduce the crevice volume by reducing the distance between the piston crown and the top ring but this causes problems because the top ring then runs hotter and reduces engine life.

OBJECTS OF THE INVENTION

The invention therefore seeks to provide a four-stroke engine in which the hydrocarbon content of the exhaust gases is reduced, especially near the end of the exhaust stroke.

SUMMARY OF THE INVENTION

According to the present invention, there is provided a four-stroke spark ignited internal combustion engine which comprises a variable volume working chamber defined between a reciprocating piston, which has at least one sealing piston ring, and a cylinder, characterised by an auxiliary chamber having a fixed volume significantly smaller than the maximum volume of the working chamber and communicating with the working chamber by a passage disposed in the cylinder wall at a position above the top piston ring when the piston is near the bottom of its stroke so that end gases at the end of the power stroke are stored in the auxiliary chamber, the auxiliary chamber communicating with the crankcase when the piston is near the top of its exhaust stroke so that the stored end gases are discharged into the crankcase.

Preferably, the auxiliary chamber is an annular chamber surrounding the cylinder and connected to the combustion chamber by a plurality of passages distributed about the circumference of the piston.

It should be mentioned that there are described in the prior art two-stroke engines which have an auxiliary chamber which is at times connected to the working chamber and at times to the crankcase. Examples of such engines are to be found in GB 2 223 802 and GB 2 083 550. Because of the fundamental differences between two-stroke and four stroke engines, these auxiliary chambers serve totally different functions and their dimensions and geometries are different from those of the auxiliary chamber required in the present invention.

In a two stroke engine, the crankcase serves to compress the charge supplied to the working chamber. In the case of GB 2 223 802 the auxiliary chamber forms part of the transfer port and does not act as a small reservoir storing a small portion of the compressed charge and transferring it to the crankcase.

The auxiliary chamber of GB 2 083 550 follows a complex sequence of connections and disconnections controlled by the side of the piston but at the bottom dead centre piston position the auxiliary chamber is not compressed as in the case of the present invention and instead gases are discharge into the working chamber at that position.

BRIEF DESCRIPTION OF THE DRAWING

The invention will now be described further, by way of example, with reference to the accompanying drawing which is a section through a cylinder of an engine of the invention.

DESCRIPTION OF THE PREFERRED EMBODIMENT

Figure 1:
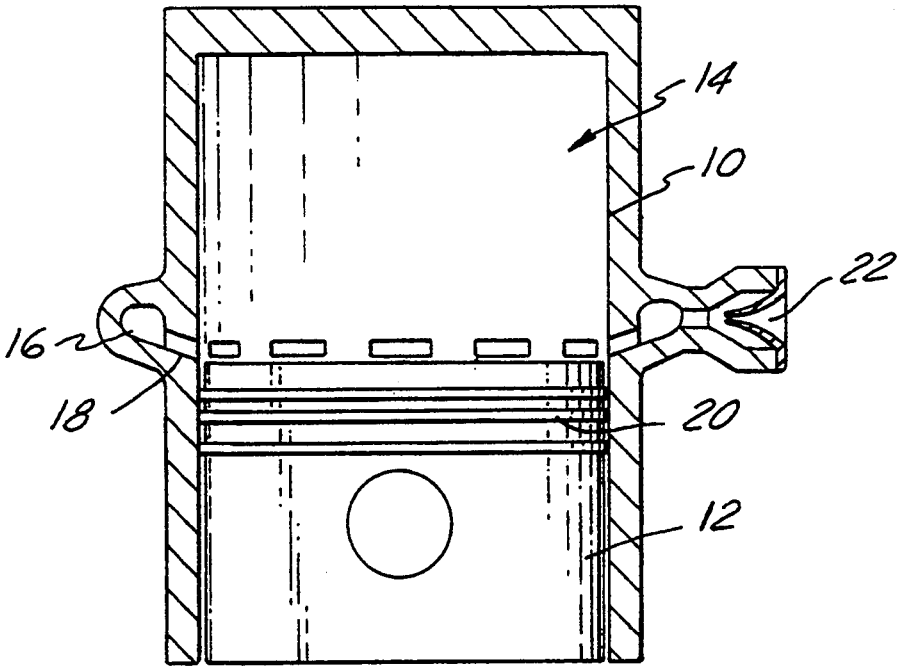

A cylinder 10 has a piston 12 reciprocable within it to define a variable volume working chamber or combustion chamber 14 of a four-stroke internal combustion engine. The piston 12 is provided in the usual manner with piston rings 20 which seal off the small gap or crevice between the piston 12 and the cylinder 10. In the drawing, the intake and exhaust valves, the ports and the spark plug have all been omitted in the interest of clarity, because these components are generally conventional and are not germane to the subject matter of the invention.

An annular auxiliary chamber 16 of small volume surrounds the working chamber 14 and is connected to it by passages 18 in the cylinder wall. Several such passages 18 are uniformly distributed about the circumference of the cylinder and are arranged immediately above the top of the piston 12 when the latter is at bottom dead centre, as shown in the drawing. The auxiliary chamber 16 is thus communicating with the working chamber 14 when the piston 12 is near bottom dead centre and communicates with the crankcase when the piston is near top dead centre.

The auxiliary chamber 16 is intended to store the end gases which in a conventional engine would have left the crevice volume at the start of exhaust stroke and remained near the top of the piston 12. At the end of the power stroke and start of the exhaust stroke, the auxiliary chamber 16 is at crankcase pressure, which is significantly lower than the pressure in the working chamber 14 and the gases near the top of the piston 12 will be forced into the auxiliary chamber 16 until the pressure in the auxiliary chamber 16 matches that in the working chamber 14. Unlike the space above the piston 12, however, the auxiliary chamber 16 is isolated from the working chamber 14 as soon as the piston 12 moves up from the bottom dead centre position and instead of being discharged to atmosphere, this trapped volume is released to the crankcase when the piston 12 clears the passages 18 leading to the auxiliary chamber 16. From the crankcase, the trapped gases are recirculated to the intake system by the usual crankcase breather to ensure complete burning of its remaining combustible hydrocarbon content in a subsequent engine cycle.

The mass of end gases transferred to the crankcase in this manner is controlled and very small. It is known that a small leakage past the piston, or blow-by as it is termed, is beneficial for reducing hydrocarbon emissions in the exhaust gases even though it is undesirable for other reasons. In effect, the auxiliary chamber of the present invention provides a controlled and selective leakage past the piston which succeeds in reducing hydrocarbon emissions but without reducing combustion pressure and engine efficiency.

Because of the small volume of the auxiliary chamber, crankcase pressure is not seriously affected by the controlled leakage. However, though the total mass of the gases is small, it does contain the high hydrocarbon fraction and thereby permits the hydrocarbon emissions discharged to atmosphere to be reduced significantly.

The action of the auxiliary chamber at the bottom of the induction stroke is also beneficial in reducing the hydrocarbon content of the exhaust gases. At the end of an engine cycle, the auxiliary chamber 16 contains mainly burnt gases at the same pressure as the crankcase, that is slightly above atmospheric pressure. The pressure in the working chamber 14 at the end of the induction stroke will be slightly below atmospheric and at the end of the induction stroke the gases will be drawn in from the auxiliary chamber into the working chamber.

Unlike the remainder of the intake charge, which is a fuel and air mixture, the gases now resting near the top of the piston have a relatively low hydrocarbon concentration. As these are the gases which will be forced into the crevice volume surrounding the piston top land in the compression and power strokes, they will tend to reduce the hydrocarbon content of the gases stored in the crevice.

In this respect, it is desirable to ensure that the gases entering from the auxiliary chamber 16 into the working chamber 14 remain near the top of the piston during the compression stroke and this can be assisted by inducing swirl about a vertical axis, this being achieved by directing the passages 18 tangentially.

It is essential that the chamber 16 be sealed in the direction of preventing escape of gases from the auxiliary chamber 16 directly to the atmosphere but it would assist the process of placing a hydrocarbon free layer of gases over the top of the piston if the volume of the hydrocarbon-free gases could exceed the volume of the auxiliary chamber 16. To that end, in the illustrated embodiment, a one-way valve 22 is provided which prevents gases from leaving the auxiliary chamber 16 but allows additional ambient air or slightly compressed air to be drawn into the auxiliary chamber 16 and from the auxiliary chamber 16 to the working chamber 14 at the bottom dead centre at the end of the induction stroke. If a significant amount of air is drawn into the working chamber by this technique and the hydrocarbon free air is successfully confined to the bottom half of the working chamber then a stratified charge engine is achieved which permits the engine to operate at low load without external throttling, thereby reducing pumping losses.

I claim:

1. A four-stroke spark ignited internal combustion engine comprising a variable volume working chamber (14) defined between a reciprocating piston (12), which has at least one sealing piston ring (20), and a cylinder (10), characterised by an auxiliary chamber (16) having a fixed volume significantly smaller than the maximum volume of the working chamber (14) and communicating with the working chamber (14) by a passage (18) disposed in the cylinder wall at a position above the top piston ring when the piston (12) is near the bottom of its stroke so that end gases at the end of the power stroke are stored in the auxiliary chamber (16), the auxiliary chamber being communicated with said passage (18) to the crankcase when the piston (12) is near the top of its exhaust stroke so that the stored end gases are discharged into the crankcase, with the auxiliary chamber having a one-way valve which is connected so as to permit air to enter the auxiliary chamber but not to escape from the auxiliary chamber.

2. An engine as claimed in claim 1, wherein the auxiliary chamber (16) is an annular chamber surrounding the cylinder (10) and communicating with the working chamber (14) by means of a plurality of passages (18) distributed about the circumference of the cylinder (10).

3. An engine as claimed in claim 1, wherein the one-way valve (22) is arranged between the auxiliary chamber and an external source of air at atmospheric pressure.

* * * * *